United States Patent [19]

Bleier

[11] 4,383,969

[45] May 17, 1983

[54] METHOD FOR REMOVING RADIOACTIVE CARBON PRODUCED IN NUCLEAR POWER PLANTS

[75] Inventor: Alois Bleier, Erlangen, Fed. Rep. of Germany

[73] Assignee: Kraftwerk Union Aktiengesellschaft, Mülheim, Fed. Rep. of Germany

[21] Appl. No.: 201,574

[22] Filed: Oct. 28, 1980

[30] Foreign Application Priority Data

Nov. 13, 1979 [DE] Fed. Rep. of Germany ..... 2945771

[51] Int. Cl.³ ..... G21C 19/42

[52] U.S. Cl. ..... 376/313; 376/314; 252/628; 423/230

[58] Field of Search ..... 376/310, 313, 314; 252/301.1 W; 423/230

[56] References Cited

U.S. PATENT DOCUMENTS 3,505,017 4/1970 Roth ..... 376/313
4,162,298 7/1979 Holladay ..... 376/314

*Primary Examiner*—Donald P. Walsh
*Attorney, Agent, or Firm*—Herbert L. Lerner; Laurence A. Greenberg

[57] ABSTRACT

Removal of small amounts of $^{14}CO_2$, $^{14}CO$ and corresponding alkanes produced in nuclear power plants from the exhaust gases of the purification plants by conversion of the radioactive compounds into $^{14}CO_2$, and removing this $^{14}CO_2$ from the main gas stream of exhaust gases.

11 Claims, 2 Drawing Figures

METHOD FOR REMOVING RADIOACTIVE CARBON PRODUCED IN NUCLEAR POWER PLANTS

BACKGROUND OF THE INVENTION

1. Field of the Invention

The present invention relates to a method for removing the small amounts of $^{14}CO_2$, $^{14}CO$ and corresponding alkanes produced in nuclear power stations from the exhaust gases of the purification plants.

2. Description of the Prior Art

In most nuclear power stations, water is used as the coolant. It is unavoidable in pressurized-water reactors and in boiling-water reactors that radioactive impurities, which may also be of a gaseous nature, get into the cooling water loop or are formed there. It is therefore customary to always branch off part of the circulating water from the main coolant loop and to conduct it through a purification plant, to remove the radioactive impurities there, to degas the water and then return it to the main coolant loop. This known technique is schematically shown for a pressurized-water reactor in FIG. 1 and for a boiling-water reactor in FIG. 2. By the extremely high radiation density in the reactor core, a very small amount of water is furthermore dissociated radiolytically into hydrogen and oxygen. In the degassification station of the purification plant, these gases are likewise liberated and changed catalytically into water again in a recombination arrangement. In this manner, the development of an ignitable hydrogen-oxygen mixture is prevented from the start. The remaining exhaust gases are customarily transported over a bed of activated carbon, where they are adsorbed, lose most of their radioactivity during the storage time and are discharged after delay into the outside air via the exhaust air stack.

The traces of radioactive carbon $^{14}C$ which is contained in the exhaust gases and has a half-life of more than 5000 years, are discharged to the outside via the stack practically unchanged. The formation of this radioactive carbon isotope is derived from the (n,$\alpha$) reaction with the oxygen isotope of the water, $^{17}O$, and also from the (n,p) reaction with possible nitrogen contaminations. This radioactive carbon is present substantially as monoxide, dioxide and as alkane.

Although only small amounts of this radioactive carbon are formed, it might become necessary with the expected increased energy production via nuclear power plants, because of the biochemical importance of this carbon isotope, to no longer discharge the latter into the free atmosphere but to collect it and to add it to the radioactive wastes.

SUMMARY OF THE INVENTION

An object of the present invention is to provide a method for separating these small shares of radioactive carbon from the exhaust gases of a nuclear reactor plant. It should be possible to retrofit the apparatus required for implementing it easily later in already existing purification and exhaust gas systems.

With the foregoing and other objects in view, there is provided in accordance with the invention a method for removing $^{14}CO_2$, $^{14}CO$ and alkanes having radioactive $^{14}C$ produced in nuclear power plants from exhaust gases of the nuclear power purification plants containing small amounts of radioactive carbon compounds, which comprises treating said exhaust gases to oxidize the radioactive carbon compounds contained in the exhaust gas to $^{14}CO_2$ and subsequently passing the oxidized exhaust gas containing $^{14}CO_2$ in contact with an absorption medium to effect removal of the $^{14}CO_2$ from the exhaust gas.

Other features which are considered as characteristic for the invention are set forth in the appended claims.

Although the invention is illustrated and described herein as embodied in a method for removing radioactive carbon produced in nuclear power plants, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
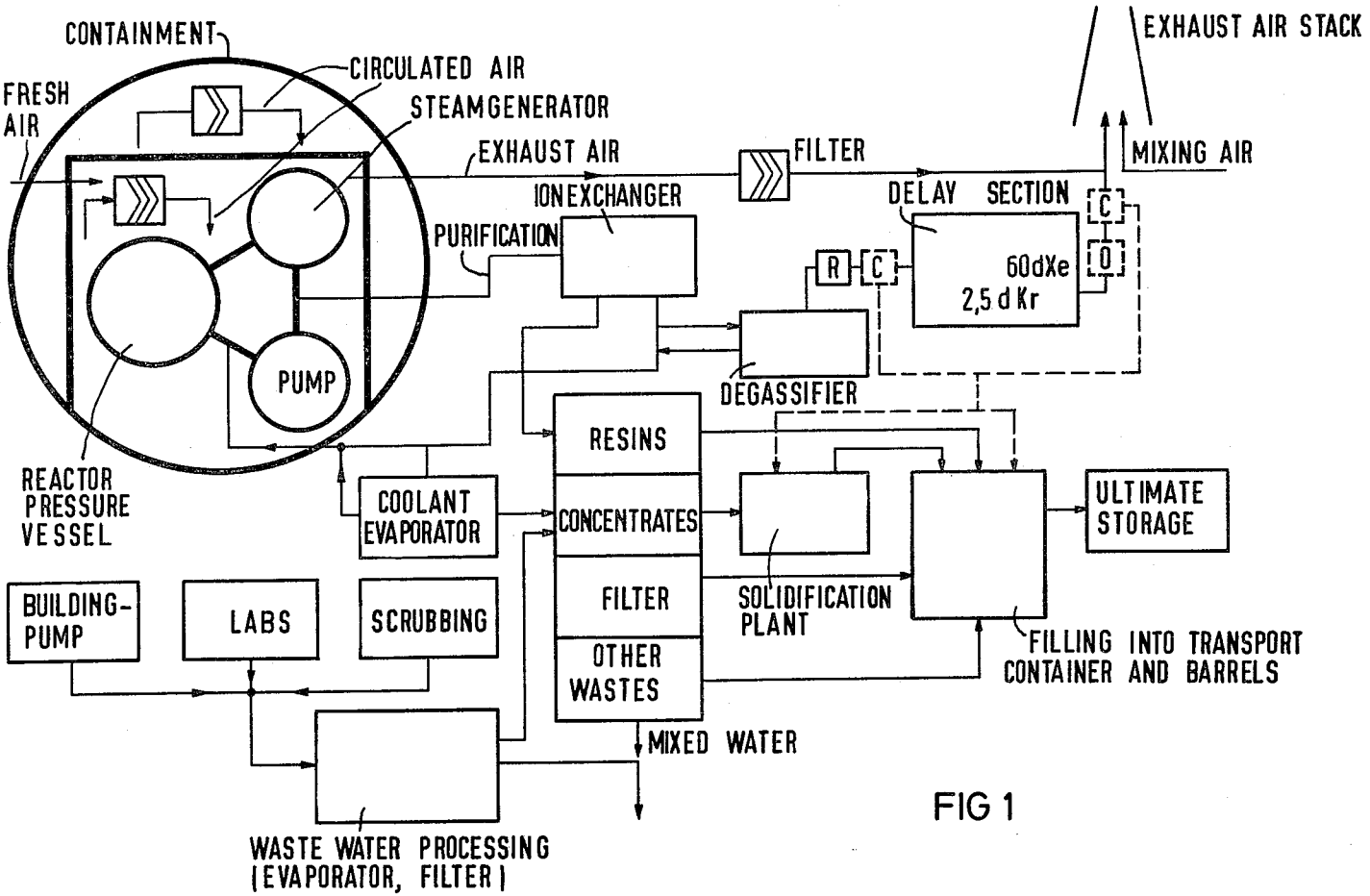
FIG. 1 schematically illustrates a nuclear power plant for a pressurized-water-reactor in which the known technique is shown in solid lines and the apparatus for implementing it in accordance with the method of the invention, in the existing system is indicated in dashed lines.
Figure 2:
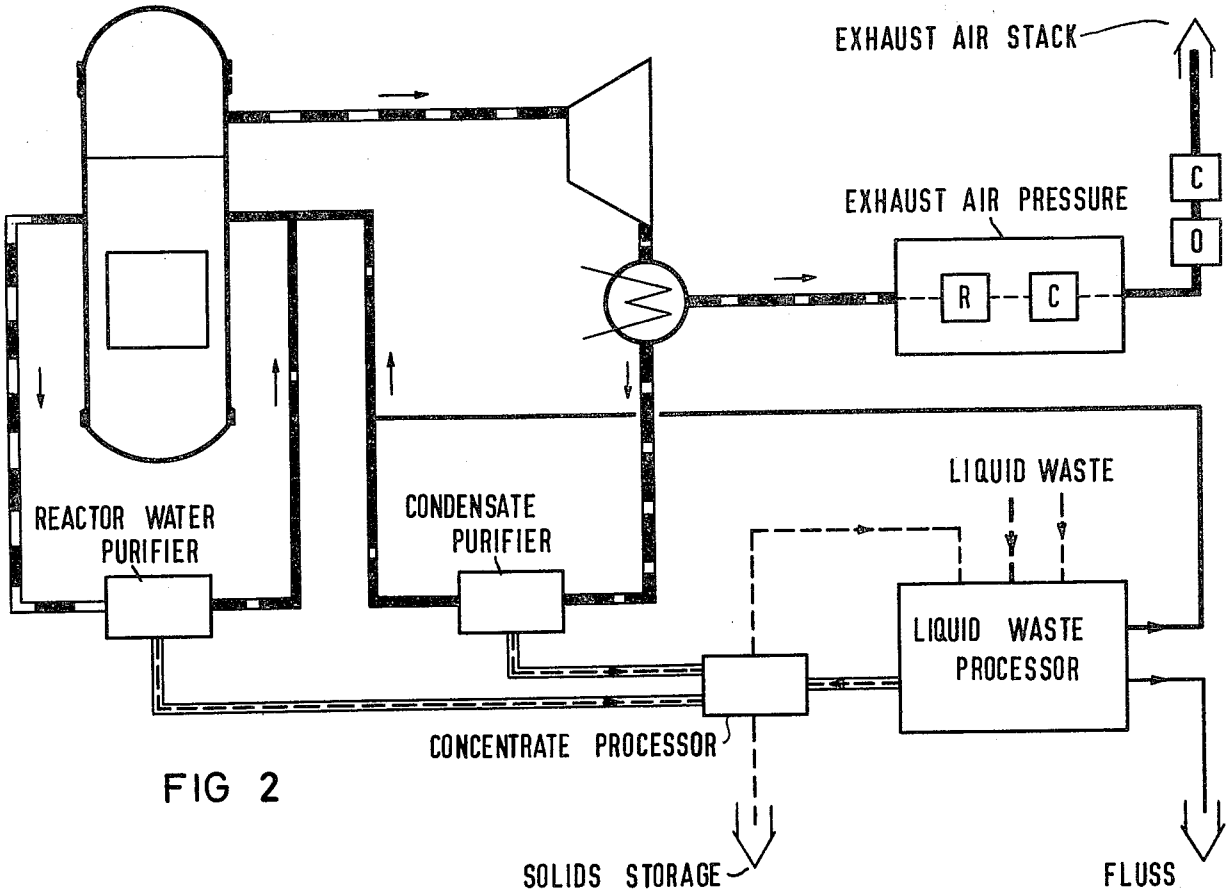
FIG. 2 similarly illustrates a known nuclear power plant with a boiling water reactor and inserted apparatus for the method in accordance with the invention.

In accordance with the invention, the radioactive carbon compounds contained in the exhaust gas are oxidized to $^{14}CO_2$ and are, subsequently, removed from the exhaust gas stream by $CO_2$— absorption and retention methods known per se. The equipment required for this purpose can be inserted, referring to the drawings, for instance, after the customary recombination arrangement R or also in the feed line leading to the exhaust air stack. The equipment serving for oxidation, designated with O, are in part similar to the recombination arrangement R. The latter consists customarily of palladium contact bodies which are heated to 300° C. These bodies consist of solid supports or carriers, for instance of $Al_2O_3$, and are generally of spherical or annular shape which are usually superficially coated with palladium. Such a known recombination arrangement R is suitable, in addition to the hydrogen-oxygen recombination, for oxidizing carbon monoxide to carbon dioxide, if a slight excess, usually about 2–8% above the amount stoichiometrically required, of oxygen is present. However, this is no longer possible with alkanes such as $CH_4$, which are substantially harder to oxidize. The R arrangement acts as an oxidizing device O only if the operating temperature of the palladium contact bodies is increased to above 450° C.

An oxidizing device meeting these purposes may be constructed from platinum contact bodies which, with a slight excess of oxygen, have an operating temperature of about 500° C. The contact bodies may also consist of copper oxide, but then, an operating temperature of at least 750° C. is necessary. The oxygen excess, which is recommended here, too, ensures continuous regeneration of the CuO.

It should be pointed out at this point that the recombination device R and the oxidizing device O can be provided as separate, as well as uniform, devices which can meet both purposes. This conversion of the radioactive compounds into $CO_2$ is the first step of the method according to the invention. The second step is to remove this $CO_2$ from the main gas stream. For this purpose, various techniques known per se are available. Thus, the $CO_2$-containing gas can be conducted through precipitation apparatus C which is filled with sodium or potassium hydroxide solution as well as with a small amount of barium chloride, and is connected to a filtering station. In the process, the $CO_2$ is precipitated as solid $Ba^{14}CO_3$ and separated in the filtering station.

It is also possible to introduce the exhaust gas directly into a $Ba(OH)_2$-solution, from which barium carbonate $BaCO_3$ precipitate can be separated.

Instead of liquid reagents, soda lime which represents a technical product of NaOH+CaO, sodium asbestos or similar technical products with comparable "alkaline" absorption effect for $CO_2$ can be used if the exhaust gas still has a small moisture content. Ensuring the latter is no problem since so-called water ring pumps are generally used for moving the exhaust gas. These use water as the sealing liquid, so that thereby humidification of the transported exhaust gas takes place automatically.

The kind of absorbents, liquid or solid, used, depends on the design and the pressure relationships of the respective purification loops and also on the physical capability of the plant to install this apparatus.

The precipitation apparatus and filter C are well known from chemical engineering, so that no further explanations are necessary on this point. The last step for freeing the exhaust gas of radioactive carbon is then merely to remove the filter residues or the precipitates from the precipitation apparatus C, to dry them and, as shown, for instance, in FIG. 1 by the dash-dotted line, to feed them to the final concentration plant and filling into barrels, which are then stored in an ultimate storage facility, without danger to the environment.

It should further be pointed out that only extremely small amounts of carbon contents to be separated in the exhaust gas are involved. An improvement of the degree of separation can therefore be achieved by first admixing an additional carrier gas which contains carbon but is not radioactive. As suitable for this purpose has been found methane gas in an amount of about 0.1% by volume of the exhaust gas. The extra amount of oxygen required is insignificant and can be taken into account in the oxygen dosing in the recombination device R.

To evaluate the practical importance of this method, it should be mentioned that the liberation of $^{14}C$ amounts to about 10 to 15 Ci/year per 1300-MW power plant and can be reduced to almost zero by the method proposed here.

I claim:

1. Method for the removal of the small amounts of carbon monoxide, carbon dioxide and gaseous alkanes in which the compounds have radioactive carbons, produced in nuclear power stations and contained in the exhaust gases of the purification plant, which comprises subjecting exhaust gases containing the mixture of carbon monoxide, carbon dioxide and gaseous alkanes in which the compounds have radioactive carbons, to oxidation to effect substantially complete conversion of the mixture of the radioactive compounds to radioactive carbon dioxide, and subsequently removing substantially all said radioactive carbon dioxide from the exhaust gases containing it.

2. Method according to claim 1, wherein said oxidation is obtained by passing said exhaust gas with a slight amount of excess oxygen in contact with palladium contact bodies at a temperature of $\geqq 450°$ C.

3. Method according to claim 1, wherein said oxidation is obtained by passing said exhaust gas with a slight amount of excess oxygen in contact with platinum contact bodies at a temperature of about 500° C.

4. Method according to claim 1, wherein said oxidation is obtained by passing said exhaust gas with a slight amount of excess oxygen in contact with CuO contact bodies at a temperature at least about 750° C.

5. Method according to claim 1, wherein said exhaust gas after oxidation is subjected to cooling and said cooled exhaust gas subsequently passed in contact with an absorption medium to effect removal of the $^{14}CO_2$.

6. Method according to claim 5, wherein said absorption medium is a sodium or potassium hydroxide solution with a small amount of $BaCl_2$.

7. Method according to claim 5, wherein said absorption medium is a $Ba(OH)_2$ solution in which $Ba^{14}CO_3$ precipitates.

8. Method according to claim 5, wherein said absorption medium is a solid alkaline absorbent material such as soda lime and sodium asbestos.

9. Method according to claim 1, wherein a non-radioactive carbon containing carrier gas is admixed with said exhaust gases.

10. Method according to claim 9, wherein the said carrier gas is methane.

11. Method according to claim 10, wherein said carrier gas is about 0.1% by volume of the exhaust gases.

* * * * *